US006164018A

United States Patent [19]

Runge et al.

[11] Patent Number: 6,164,018

[45] Date of Patent: Dec. 26, 2000

[54] CINEMATIC THEATER AND THEATER MULTIPLEX

[75] Inventors: Gary E. Runge, Fond du Lac, Wis.; Albert R. Kolkmeyer, Yorkville, Ill.

[73] Assignee: Shopro, Inc., West Bend, Wis.

[21] Appl. No.: 09/206,530

[22] Filed: Dec. 7, 1998

Related U.S. Application Data

[60] Provisional application No. 60/067,860, Dec. 8, 1997.

[51] Int. Cl.[7] ..... E04H 3/22

[52] U.S. Cl. ..... 52/8; 52/6; 52/174; D25/12

[58] Field of Search ..... 52/6, 8, 174, 175, 52/176, 236.1; D25/12

[56] References Cited

U.S. PATENT DOCUMENTS

| | | | |
|---|---|---|---|
| 2,102,718 | 12/1937 | Josserand | 52/6 |
| 2,895,179 | 7/1959 | Wilson | 52/6 |
| 3,002,233 | 10/1961 | Obata | 52/7 |
| 3,487,595 | 1/1970 | Schumann | 52/8 |
| 3,668,810 | 6/1972 | Bankston | 52/6 |
| 3,823,517 | 7/1974 | Penaloza | 52/6 |

*Primary Examiner*—Laura A. Callo
*Attorney, Agent, or Firm*—Quarles & Brady LLP

[57] ABSTRACT

A theater has a pair of perpendicular front walls and a pair of perpendicular rear walls, with each of the front walls parallel to one of the rear walls. A screen wall tuncates the corner between the front walls and is bisected at its center by a diagonal which bisects the space delimited by the front walls and rear walls. A pod of four theaters is arranged so that their truncated rear comers converge in a common area, and a projection booth is built above the common area to house the projectors for all four theaters.

5 Claims, 3 Drawing Sheets

CINEMATIC THEATER AND THEATER MULTIPLEX

CROSS-REFERENCE TO RELATED APPLICATION

This application claims the benefit of the filing date of U.S. Provisional Patent Application Ser. No. 60/067,860 filed Dec. 8, 1997.

STATEMENT CONCERNING GOVERNMENT SPONSORED RESEARCH OR DEVELOPMENT

Not Applicable.

BACKGROUND OF THE INVENTION

1. Field of the Invention

This invention relates to building design, and in particular to a design of a theater, particularly a cinematic theater, and of a multiplex of such theaters.

2. Discussion of the Prior Art

Most theaters are generally wedge-shaped with the movie screen at the small side of the wedge, the sides flaring out from the screen in either straight or curved lines, and the seats generally facing the screen in either straight or curved rows. The floor in such a theater may either be flat, generally perpendicular to the screen, but more commonly slants downward toward the screen, so that people sitting in back can see over the heads of people sitting in front. It has also been popular to have at least a portion of the floor made stepped with the higher steps toward the rear of the theater. This stepped type of seating is known as stadium seating.

Employing stadium seating adds to the cost of building a theater, in comparison to the cost of building a theater with the usual slanted, unstepped, floor. One reason stadium seating adds to the cost is that it increases the number of square feet required per seat as compared to providing unstepped seating where the aisles between seats can be somewhat narrower.

In addition, regardless of whether stadium or conventional seating is employed, the cost of construction rises when non-conventional construction methods are used. For example, if walls or rooms are made of unusual shapes, the cost goes up, since making a wall curved or at an angle other than perpendicular is more expensive than making a wall straight and room corners square. Also, space can be used more efficiently when rooms are made with square comers. Thus, a need exists for a theater design which efficiently utilizes space, in both stadium and non-stadium seating arrangements.

SUMMARY OF THE INVENTION

The invention provides a theater and theater multiplex which is constructed so as to make efficient use of space using commonly available building materials and building techniques. A theater of the invention is essentially a rectangular, and preferably square, room, with the screen diagonally truncating one comer of the room and the seats facing the screen. Thus, a theater of the invention has a pair of front walls perpendicularly oriented relative to one another and a pair of rear walls perpendicularly oriented relative to one another. The front walls, which are adjacent to the screen, open outwardly toward the rear of the theater, being at a right angle to one another. The rear walls, at a right angle to each other, are arranged to delimit the room, and each of these rear walls is generally parallel to one of the front walls.

In preferred aspects, the seats are arranged in curved rows so as to obtain the best viewing angle toward the screen. The rear walls walls may be built out at places so as to fill in dead space behind the seats. The comer between the rear walls is truncated with a diagonal wall which is generally parallel with the screen so as to fill in the dead space behind the rear row of seats, and define a storage area behind the rear diagonal wall.

In a multiplex incorporating theaters of the invention, a pod of four theaters of the invention can be arranged with their rear comers converging in a common area, so the four theaters all emanate from the common area of the pod. With this arrangement, the two theaters on each side of a common hall have a rear wall in common. At an upper mezzanine level, above the floor seating level of the theaters, a projection booth is built, which is a single room at the nucleus that contains the projectors for the four theaters. Thereby, a single projectionist can efficiently operate the projectors for all four theaters and with a minimum of additional structure to accomodate the projectors.

Any number of additional pods of two or four theaters can be added by simply building them onto the end of the theater, using a central hallway which is common to all of the pods. A common concession, restroom, etc. area can also be provided at one or both ends of the multiplex.

The foregoing and other objects and advantages of the invention will appear in the detailed description which follows. In the description, reference is made to the accompanying drawings which illustrate a preferred embodiment of the invention.

DETAILED DESCRIPTION OF THE PREFERRED EMBODIMENT

Figure 1:
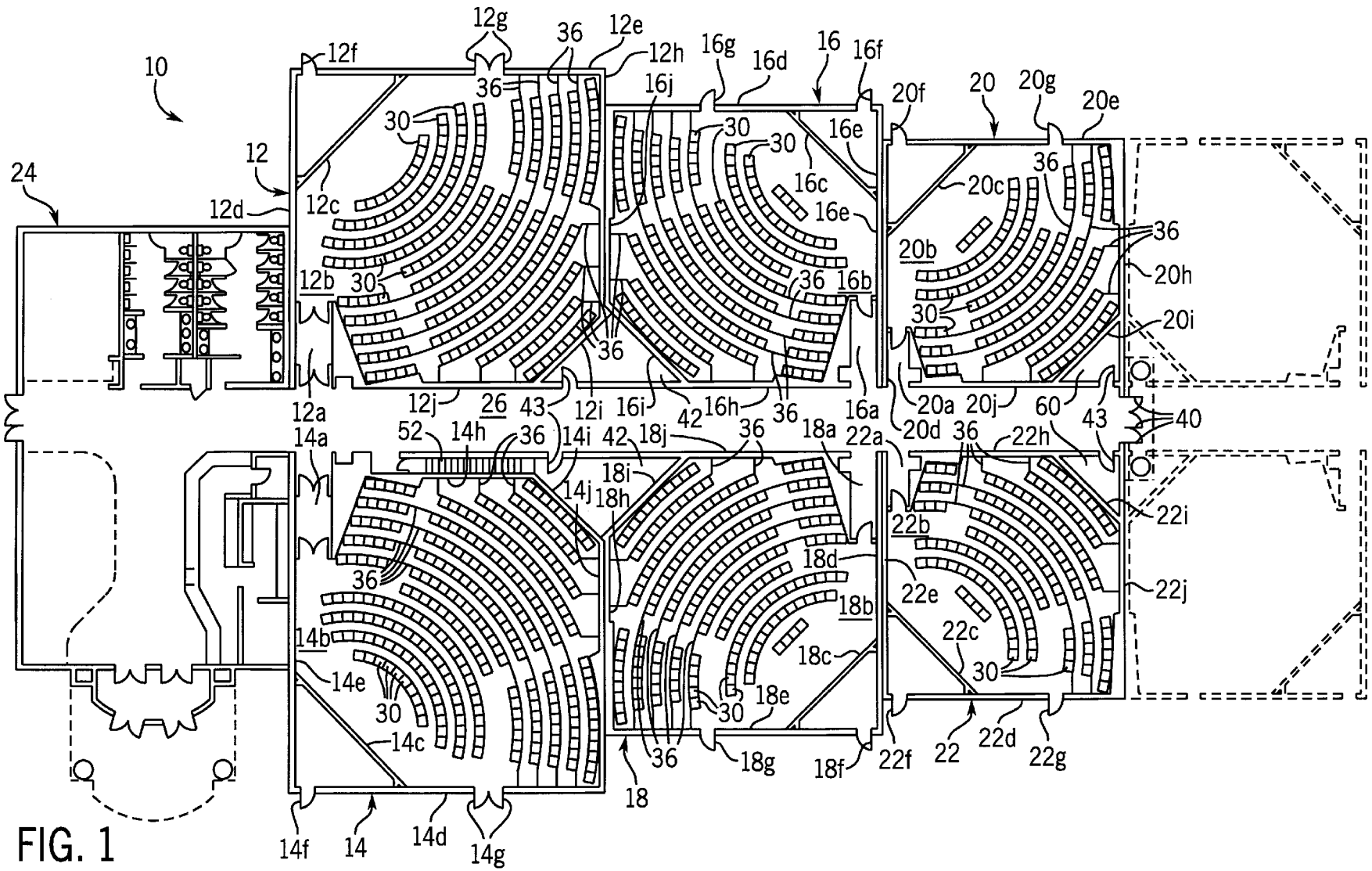
FIG. 1 is a top main floor plan view of a multiplex theater incorporating the invention.

FIG. 1 illustrates a six theater cinematic multiplex 10 having six generally square theater rooms 12, 14, 16, 18, 20, and 22, and a common concession area 24. The theater rooms 12 and 14 are approximately the same size, the rooms 16 and 18 are smaller and approximately the same size, and the rooms 20 and 22 are still smaller and approximately the same size. A common hallway 26 separates the theaters 12, 16, and 20 from the theater rooms 14, 18, and 22 and provides a passageway for entry and egress from the theater rooms 12, 14, 16, 18, 20, and 22.

All of the theater rooms 12, 14, 16, 18, 20, and 22 are of the same general configuration, and so only one, the room 12, will be described in detail, with the corresponding reference numerals applied to the others. Thus, the room 12 has an entry and egress vestibule 12*a*, which preferably has a pair of spaced apart doors and is located at one of the comers of the room 12 so as to provide passage to and from the hallway 26. An aisle 12*b* leads from the vestibule 12*a* all the way up to the screen 12*c* which is located in the corner of the room 12 which is directly in front of the vestibule 12*a*. The wall 12*c* on which the screen is mounted or suspended extends between the wall 12*d*, which extends from the vestibule 12*a*, and the wall 12*e* which is at 90 degrees to the wall 12*d*. The area behind the screen wall 12*c*, which is bordered by the comer between the walls 12*d* and 12*e*, may be used for storage, and preferably has a doorway to the outside of the room 12, as shown at 12*f*. An alternate means of egress is also preferably provided to the room 12 by the double doors 12*g*. Wall 12*e* extends beyond the doors 12*g* rearwardly from the screen wall 12*c* and forms a right angle comer with rear wall 12*h* which extends from wall 12*e*, parallel to the wall 12*d*. Rear wall 12*h* extends to rear wall 12*i* which forms roughly a 45 degree angle with wall 12*h* and is parallel to the screen wall 12*c*. Rear wall 12*i*, which is generally parallel to the screen wall 12*c*, extends to rear wall 12*j* which runs generally parallel with side wall 12*e*. Wall 12*j* extends from the rear wall 12*i* over to the vestibule 12*a*, and is shaped so as to eliminate dead space behind and to the side of the left rear wing of seats 30. Each rectangle 30 represents one seat. Wall 12*h* is also shaped so as to eliminate the dead space behind the right wing of seats 30.

Figure 2:
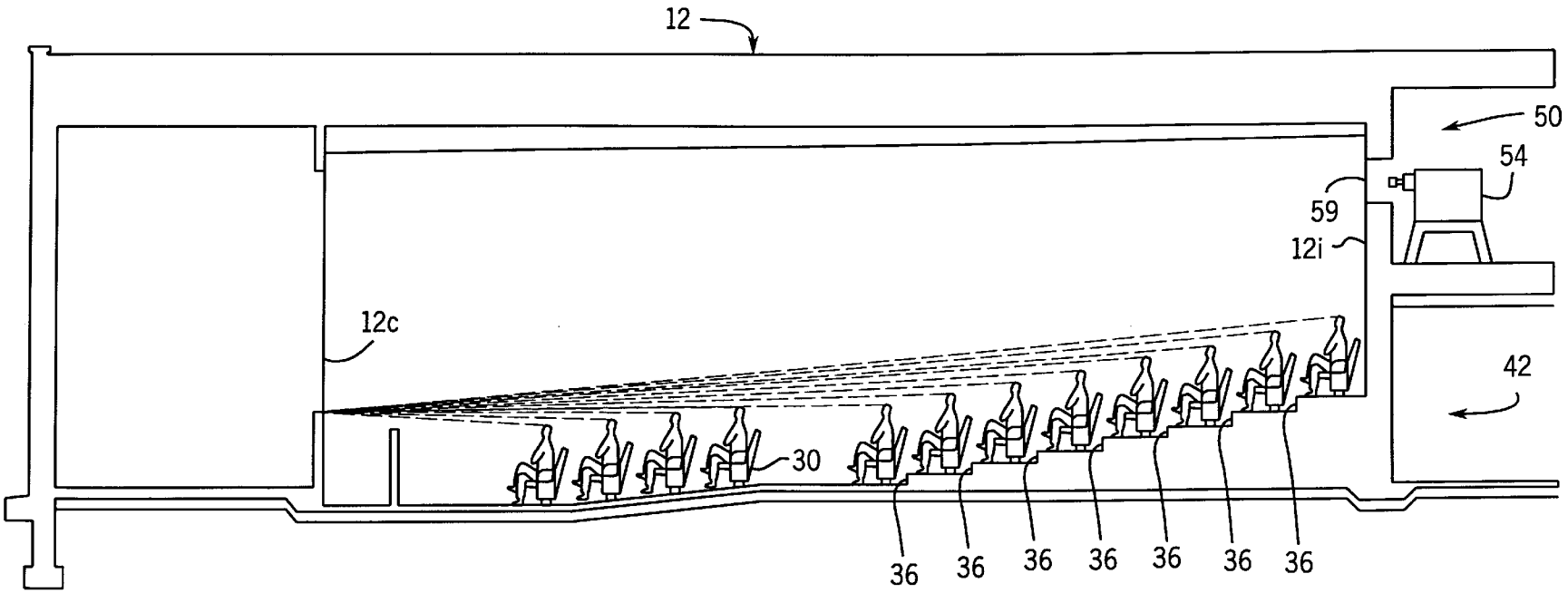
FIG. 2 is a side cross-sectional view from the plane of a diagonal of theater 12 of FIG. 1.

Referring to FIGS. 1 and 2, at the front of theater 12, i.e., the area of the theater closest to the screen wall 12*c*, the floor is flat. Rearwardly, the floor ramps up, and further rearwardly, the floor is stepped with steps 36, to provide stadium seating. Theaters 12 and 14 have seven steps. The theaters 16 and 18 have six steps, and the theaters 20 and 22 have 4 steps. Theater 12 is illustrated in FIG. 2 which shows the floor arrangement and the line of site provided by the theater 12.

While six theaters 12, 14, 16, 18, 20, and 22 are shown in FIG. 1, any number could be provided, and they could be made all the same size or all different sizes as shown. In phantom, it is illustrated how the six-plex 10 could be made into an eight-plex. If so, the exit doors 40 and are simply moved to the end of the building.

A unique feature of each of the theater rooms 12, 14, 16, 18, 20 and 22 is that each is essentially a square room, with the screen wall making up the hypotenuse of an isosceles right triangle and the seat rows all facing the screen, with a diagonal of the room which bisects the screen wall bisecting the seat rows. It is said that each room is generally square, because its opposed walls are equally spaced with substantial parallel sections. The only exception to this is the walls such as the wall 12*i* and the bumpouts which serve the purpose of filling in the dead space behind the seats. It is noted also that the wall 12*i* can be used to define a small generally triangular-shaped storage area 42, having a door 43 into the hallway 26.

A theater of the invention can be made with either a flat floor, a sloping floor (not shown), or a combination of a flat floor or sloping floor and stadium seating as illustrated in FIGS. 1 and 2. Using the stadium seating as illustrated is particularly beneficial as compared with conventional stadium seating theater arrangements so as to make more efficient use of the floor space.

Figure 3:
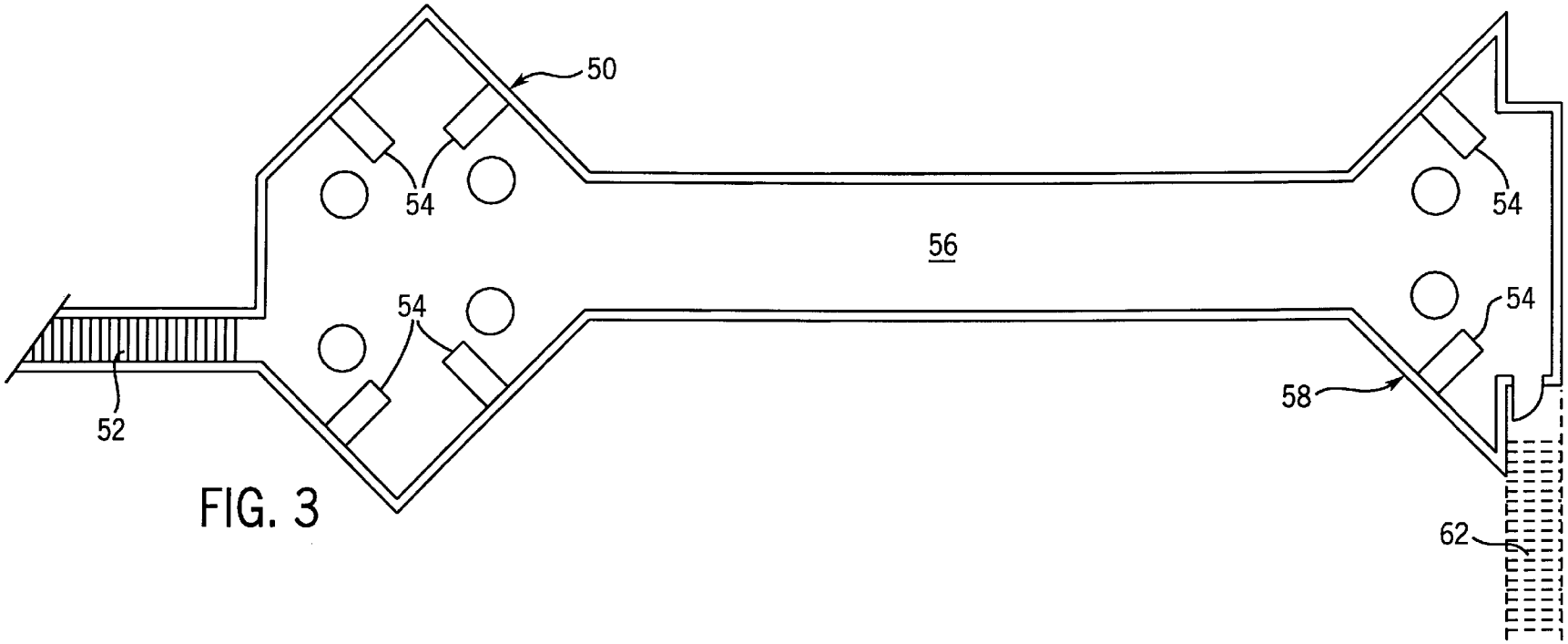
FIG. 3 is a top plan view of the upper level mezzanine incorporated in the theater illustrated in FIG. 1.

FIG. 3 illustrates the top upper mezzanine floor plan. The projection booth 50 is directly above the common area of the pod of theaters 12, 14, 16 and 18 where the rear corners of the theaters converge, i.e., the projection booth 50 is directly above the two storage areas 42 and the portion of the hall 26 which is between them. Stairway 52 is shown in both FIG. 1 and in FIG. 3 and gives a positional reference. Thus, when arranging four theaters such as the theaters 12, 14, 16, and 18, a single projection booth 50 with four projectors 54 can be used. Since a single projectionist would typically operate all of the projectors in the multiplex, this makes it extremely convenient and efficient for the projectionist. A hallway 56 (above hallway 26) on the mezzanine level connects the projection booth 50 with a two projector booth 58 which would be above the storage areas 60, which are at the end of the multiplex building 10, and the portion of hallway 26 between them. An optional stairway 62 may be provided to the outside where required or desired. Each wall of the booth 50 and the two walls of the booth 58 have a window 59 (FIG. 2) through which the corresponding projector 54 may project.

Thus, the invention provides a theater which efficiently utilizes space and construction materials, using ordinary building techniques. A theater of the invention has a pair of perpendicular front walls, and a pair of perpendicular rear walls, with each of the front walls parallel to one of the rear walls. The screen wall is positioned connecting the front walls, and is bisected at its center by a diagonal which bisects the theater relative to the front and rear walls. The diagonal is at approximately 45° to each of the front and rear walls, and cuts in half, or bisects, the space defined between the front and rear walls. Thus, the room is rectangular, and preferably square, with the screen diagonally truncating one comer of the room. Seats face the screen in curved rows so as to obtain the best viewing angle toward the screen, with the diagonal line, which runs through the point of intersection of the front walls and through the point of intersection of the rear walls (if those walls were extended to their points of intersection), also bisecting the rows of seats. For the best utilization of the advantages of the invention, the seat rows are stepped toward the rear of the room to provide stadium seating.

In a multiplex incorporating theaters of the invention, a pod of four theaters, e.g., theaters 12, 14, 16 and 18, of the invention are preferably arranged with their rear corners in a common area or nucleus, so the four theaters all emanate from the common area, or nucleus, of the pod. Two of the theaters of the pod are on one side of a common hallway, and the other two theaters of the pod are on the other side. The two theaters of the pod on each side of the hallway preferably have a rear wall in common, i.e., the two theaters 12 and 16 have the walls 12*h* and 16*j* in common, and the theaters 14 and 18 have the walls 14*j* and 18*h* in common. In addition, the common walls of each two theaters that share a wall are aligned, i.e., common wall 12*h*, 16*j* is aligned with common wall 14*j*, 18*h*.

At an upper, mezzanine level, above the floor seating, or viewing, level of the theaters, a projection booth is built, which is a single room at the nucleus that contains all four projectors for the four theaters. Thereby, a single projectionist can efficiently operate the projectors for all four theaters and with a minimum of additional structure to accomodate the four projectors. Any number of additional pods of two or four theaters can be added by simply building them onto the end of the theater, using a central hallway which is common to all of the pods. If a pod of two theaters, e.g., theaters 20 and 22, is provided, a single projection booth can be used for both projectors, with a hallway above the central theater hallway connecting the projection booths. A common concession, restroom, etc. area can also be provided at one or both ends of the multiplex.

A preferred embodiment of a theater and theater multiplex of the invention has been described in considerable detail. Many modifications and variations to the preferred embodiment will be apparent to those skilled in the art which will still incorporate the invention. Therefore, the invention should not be limited to the preferred embodiment, but should be defined by the claims which follow.

What is claimed is:

1. A multiplex of cinematic theaters, comprising first and second pods of two theater rooms each, said two theater rooms of each said pod being on a viewing level of said multiplex and being separated from each other by a common wall, each said theater room including:

a pair of front walls which are oriented perpendicular to one another;

a screen wall between said pair of front walls, said screen wall being at an angle to each of said front walls; and seating facing said screen wall;

said multiplex further comprising:

a hallway extending between said two pods which separates said two pods from one another, said hallway being accessible from all four of said theater rooms of said two pods.

2. A multiplex of cinematic theaters as claimed in claim 1, wherein each of said four theater rooms has a central rear zone at a location in said room which is diagonally opposite from said screen wall, and wherein said rear zones converge in a common area of said two pods.

3. A multiplex of cinematic theaters as claimed in claim 2, further comprising a mezzanine level above said viewing level, and wherein said mezzanine level includes a projection booth which is common to said four theaters of said two pods, said projection booth accommodating at least one projector for projecting onto the screen wall of each theater of said two pods and being positioned above said hallway and said common area.

4. A multiplex of cinematic theaters as claimed in claim 3, further comprising a third pod of two theater rooms on said viewing level of said multiplex, each said theater room of said third pod including:

a pair of front walls which are oriented perpendicular to one another;

a screen wall between said pair of front walls, said screen wall being at an angle relative to each of said front and rear walls; and seating facing said screen wall;

wherein an extension of said hallway separates said two rooms of said third pod from one another;

wherein each said room of said third pod has a rear zone at a location in said room which is opposite from said screen wall, and wherein said rear zones converge in a common area of said third pod; and wherein said mezzanine level includes a second projection booth which is common to said theater rooms of said third pod and is connected by a hallway to said first mentioned projection booth, said second projection booth accommodating at least one projector for projecting onto the screen wall of each theater room of said third pod and being positioned above said hallway and said common area of said third pod.

5. A cinematic theater as claimed in claim 1, wherein each said theater room further comprises a pair of rear walls which are oriented perpendicular to one another, each of the two walls of said pair of front walls of said theater room being parallel to one of the two walls of said pair of rear walls, said front and rear walls of said theater room defining between them a certain space in which said seating is contained.

* * * * *